United States Patent [19]
Schaefer

[11] Patent Number: 4,475,830
[45] Date of Patent: Oct. 9, 1984

[54] SPLICELESS RIBBON STRUCTURE HAVING LEADER AND TRAILER AND METHOD OF MANUFACTURE THEREFOR

[75] Inventor: John O'N. Schaefer, Lexington, Ky.

[73] Assignee: International Business Machines Corporation, Armonk, N.Y.

[21] Appl. No.: 405,633

[22] Filed: Aug. 5, 1982

Related U.S. Application Data

[63] Continuation-in-part of Ser. No. 306,791, Sep. 29, 1981, abandoned.

[51] Int. Cl.[3] ..... B41J 31/05
[52] U.S. Cl. ..... 400/238; 156/235; 156/249
[58] Field of Search ..... 400/237, 238, 248, 250, 400/696; 156/235, 248, 234, 249

[56] References Cited

U.S. PATENT DOCUMENTS

| | | | |
|---|---|---|---|
| 2,789,677 | 4/1957 | Zaiser | 400/238 |
| 2,847,106 | 8/1958 | Yawger et al. | 400/238 |
| 3,286,808 | 11/1966 | Arena et al. | 400/238 |
| 4,007,823 | 2/1977 | Barouh et al. | 400/696 |

FOREIGN PATENT DOCUMENTS

| | | | |
|---|---|---|---|
| 405300 | 10/1924 | Fed. Rep. of Germany | 400/238 |
| 1129820 | 5/1962 | Fed. Rep. of Germany | 400/237 |
| 2455575 | 7/1975 | Fed. Rep. of Germany | 400/238 |
| 845825 | 5/1939 | France . | |
| 109787 | 8/1981 | Japan | 400/237 |
| 240279 | 10/1925 | United Kingdom | 400/238 |

*Primary Examiner*—William Pieprz
*Attorney, Agent, or Firm*—Laurence R. Letson

[57] ABSTRACT

A ribbon of the single use film substrate, completely transferrable ink layer type, is disclosed wherein the leader and trailer are formed by adhering over the inked side of the ribbon a thin adhesive faced tape or foil and where the tape or foil is adhesively engaged with the substrate in a region having had all or part of the ink removed therefrom to provide an adherent surface. The tape or foil is further provided with a region of adhesive engagement for attachment to supply and takeup spools.

15 Claims, 13 Drawing Figures

FIG. 1
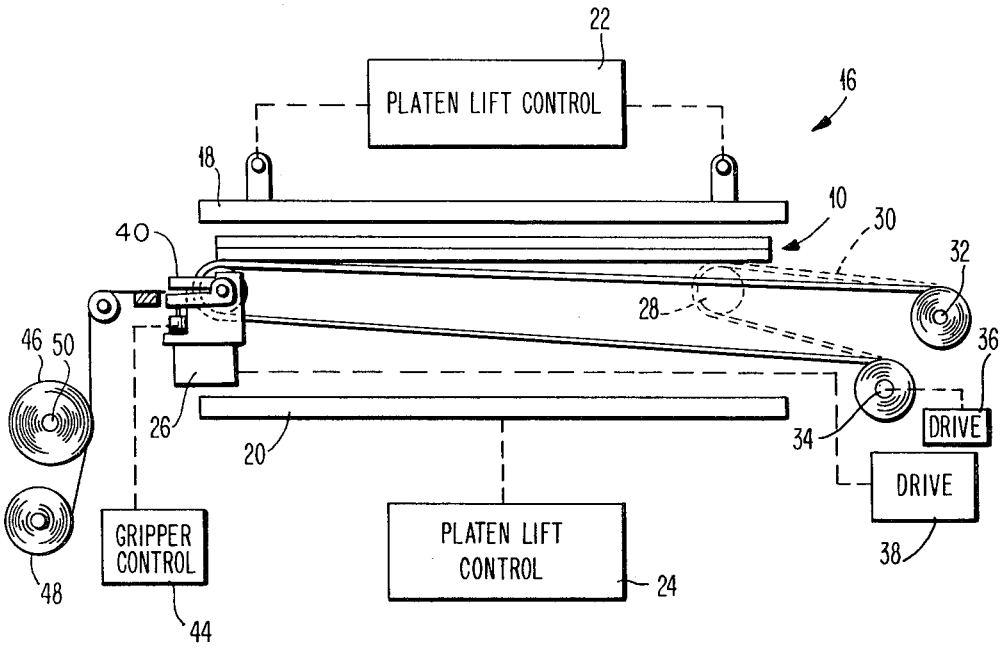
FIG. 2
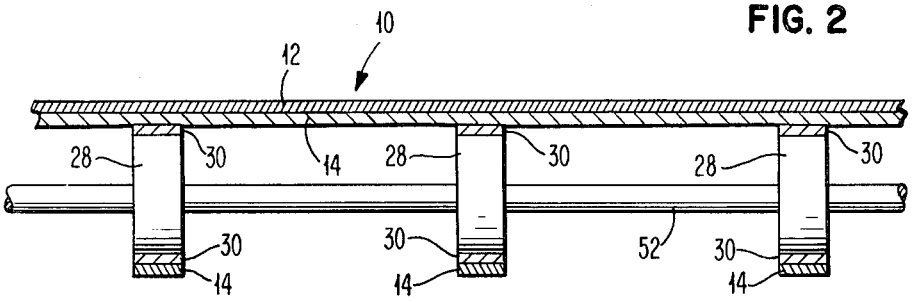
FIG. 3
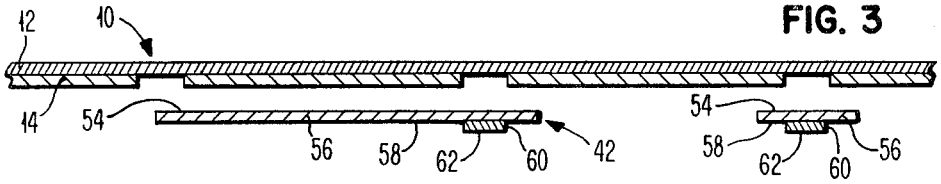
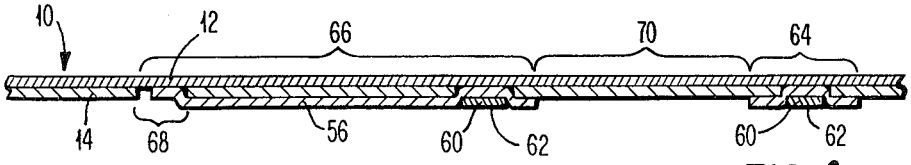
FIG. 4

SPLICELESS RIBBON STRUCTURE HAVING LEADER AND TRAILER AND METHOD OF MANUFACTURE THEREFOR

This application is a continuation-in-part application of application Ser. No. 306,791 filed Sept. 29, 1981 now abandoned.

BACKGROUND OF THE INVENTION

When ribbon is manufactured, the substrate material such as a cast polyethylene is coated in large wide rolls with an ink material which is capable of being transferred from the substrate to the printed page by impact. As this material is fed from the large wide rolls referred to as jumbo rolls, it is slit by a slitter and wound upon individual ribbon cores for subsequent use on a printer or typewriter. After an appropriate amount of ribbon has been wound upon the cores, the slitter is stopped and a segment of the ribbon stock which remains unslit is cut out and a non-inked material typically spliced into the gap to form a leader and trailer. This material is then passed through the slitter to subdivide it in width to the width of the ribbons being spooled and is wound partially onto the spool in the slitter. At this point, the ribbon stock and slitter are stopped and the ribbon spool wound with ribbon and leader are severed near the center of the leader/trailer film. A portion of the material accompanies the ribbon on the spools, thus forming a spliced-on leader. The remaining portion of the leader/trailer material which has been severed is then attached to new empty spools to form the spliced-on trailer and it is then wound along with ribbon onto the spools to the desired diameter. The cutting of the ribbon stock and the subsequent splicing in and slitting of the leader/trailer material then has the potential of causing misalignment and thus causing the spools to not wind uniformly. When this occurs, the ribbon spool and the ribbon thereon are rejected as improperly wound and discarded, thus increasing the cost of the ultimate product. Additionally, if leader/trailer material is not firmly taped into the bulk ribbon strands, the bond may break, requiring rethreading of the slitter and the subsequent loss of a large number of ribbons in production.

The prior art technique requires the assembly of several separate webs to accomplish the formation of the leader trailer composite and then this material must be adhesively attached to the film of the ribbon. U.S. Pat. No. 3,286,808 to John P. Arena, et al, is an example of such a ribbon structure and the assembly of a plurality of tapes and foils in precise controlled locations.

As taught in the prior art and by industry standards, a ribbon leader is normally a spliced-in assembly and serves to carry the attaching tape, which is used to connect the start of the ribbon to the takeup spool, and further serves to provide a clean handling length of material to protect the operator from ink contamination during the loading of the ribbon into the typewriter. Similarly, a ribbon trailer is a spliced-in assembly of tape and film and serves to carry the attaching tape which is used to attach the end of the ribbon assembly to the center or supply hub. Additionally, the spliced-in trailer assembly typically provides a visual end of ribbon warning via its contrasting color and further provides a threshold print interruption feature to terminate printing before ribbon feed becomes inhibited by the lack of additional ribbon supply. An interruption in feed can have the undesirable effect of causing light and dark characters which require subsequent correction before typing can be continued. One common undesirable effect of a contrasting colored trailer material is that the typewriter can impact the material upon ribbon depletion, thereby causing a transferring of the colored material to the typed page which usually cannot be corrected.

With the large number of tapes and foils required to form the prior art leader and trailer composite, and the subsequent splicing-in of the assembly into the bulk ribbon strand or web (together with the removal of the span of ribbon material to accommodate the leader and trailer), an automated assembly of such a ribbon structure is impractical inasmuch as the materials are thin and tend to tangle, pucker, and tear, and in view of the fact that the alignment is critical during the passage of the leader/trailer composite through the slitter.

State of the art ribbon slitters used in industry all bring the ribbon past the leader/trailer station in a "face down" or ink down fashion. Since the key element of both the leader and trailer is the adhesive attaching means used to attach both ends of the ribbon to their respective spools, it is generally not possible to make even the simplest form of leader and trailer, having only these attaching means, without cutting into the ribbon web and splicing-in a section of leader and trailer assembly.

SUMMARY OF THE INVENTION

The present ribbon structure is formed to eliminate problems experienced with the prior art assembly technique and ribbon structures by adhesively placing into position with the ribbon separate leader and trailer foils having at least one adhesive side and engageable with the ink side of the substrate of the ribbon structure. In the simplest form, both the leader and trailer can consist of single strips of double-sided tape, where one adhesive surface attaches to the ribbon stock and the other used later to attach the ribbon ends to their respective hubs. In the preferred embodiment, the leader and trailer will each be a laminate of variable length foils first attached to the ribbon stock and having no adhesive on the back or outside and having attached to the non-adhesive side, the double-sided tape above described. To insure adequate adhesion between the adhesive foils forming the leader and trailer, a band of ink is removed from the ribbon substrate transverse to the path of the ribbon and the adhesively faced foils are then engaged with the substrate of the ribbon structure as well as the ink lying beyond the respective bands and in the area encompassed by the said leader/trailer foils. Such engagement with the bands by the adhesive face of the leader and trailer insures adhesion of the leader/trailer to the ribbon structure notwithstanding the relatively easy removal of the ink from the substrate of the ribbon. Further, the adhesion of the trailer to the ink face of the ribbon structure insures that the ink is encapsulated in the laminate and is thus not capable of transfer to the paper when impacted by a printing element. Inasmuch as there is no colored material available to the typed sheet, no transfer may occur and thereby spoil the text appearance on the typed sheet when the ribbon is exhausted. The width of the trailer may be adjusted to provide an adequately long trailer to insure typed interruption before the trailer is pulled from the spool of the ribbon core. Similarly, the length of the leader may be adjusted to provide a length of ink encapsulated ribbon to provide clean loading of the ribbon where required.

Additionally, one of the bands of ribbon substrate from which the ink has been removed prior to attaching the leader/trailer thereto, will act as a warning of a visible nature to the operator that the ribbon end is near. Thus, when the operator observes this transparent gap in the trailer approaching the print point, the operator may change the ribbon at that time without interrupting printing or can continue typing until the transparent gap interrupts printing in the normal fashion.

The assembly of the ribbon structure prior to slitting may be accomplished with special mechanisms by engaging the underneath or ink surface of the bulk ribbon structure transverse to the long axis of the ribbon stock with an adhesive tape and forcibly adhering the tape to the ink and pulling the tape from proximity of the ink surface thereby removing the ink from the substrate. This may be accomplished readily by passing an adhesive tape around a wheel which is moveable across the width of the bulk roll of tape where the wheel can force the tape into adhesive engagement with the ink and as the wheel rolls and the tape is taken up onto a takeup apparatus, the ink is pulled from the substrate. As the wheels and the tape contact point progresses laterally across the bulk ribbon stock removing a plurality of bands of ink from the substrate, the leader/trailer foils may be pulled from separate rolls and positioned relative to the ribbon width such that the foils and ribbon will lie in substantially face to face arrangement, whereupon two platens, one on either side of the composite structure, are forced together to accomplish the sandwiching. Upon severing of the foil members, the laminated structure of the foil composites and ribbon stock may then be slit in a conventional manner.

The advantages in the structure of the ribbon as described herein and the procedure for assembling the composite ribbon/trailer/leader structure are significant from a reliability as well as cost minimization viewpoint.

The use of the foils as laminates instead of spliced-in leader and trailer assemblies maintains spliceless integrity of the ribbon web for guiding, feeding and slitting and thereby insures enhanced alignment upon passage through the slitter and a reduced number of defective ribbon rolls due to skewed ribbon and pulled apart splices.

Additionally, the apparatus and structure are such that the slitting and spooling operations are greatly enhanced due to the elimination of the need to remove a segment or span of the bulk ribbon web.

A further advantage is that the ribbon provides a precise end of ribbon warning without the possibility of a transfer of either a partial ink layer or color from a trailer thereby spoiling the appearance of the typed copy.

DRAWING

FIG. 1 illustrates an apparatus for positioning and assembling the foil composite to the ribbon structure.

FIG. 2 illustrates the removal of the ink layer from the ribbon structure.

FIG. 3 illustrates the ink layer having been removed from the ribbon structure and the positions of the foil composites prior to adhesive engagement with the ribbon structure.

FIG. 4 illustrates the position of the ribbon composites forming the leader/trailer when in a sandwiched or assembled position.

DESCRIPTION OF THE INVENTION

Figure 5:
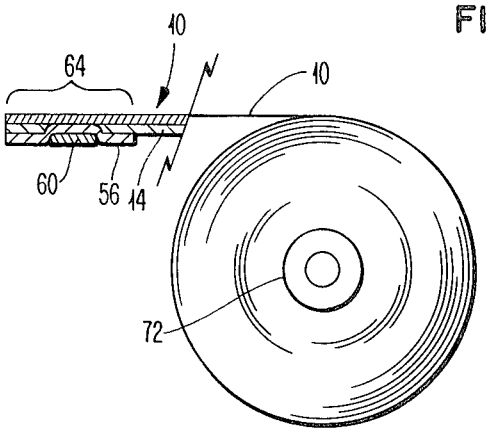
FIG. 5 illustrates the ribbon spool with the ribbon wound upon the supply spool and having an enlarged sectional view of the leader portion of the ribbon.

As ribbon stock is unrolled from a jumbo roll and fed to a slitter, as is conventional, the ribbon stock 10 comprising a substrate 12 and an ink layer 14 will pass through a leader/trailer station 16 illustrated in FIG. 1. The ribbon 10 is positioned between an upper platen 18 and a lower platen 20. The platens 18 and 20 are flat plates which are moveable into a position where they forcibly engage opposite sides of the ribbon 10.

In the position illustrated in FIG. 1, platens 18 and 20 are withdrawn and held withdrawn by platen lift control 22 and 24. With the platens 18 and 20 withdrawn from their juxtaposed position, a space sufficient to traverse the ribbon web 10 with carrier 26 is provided. Carrier 26 carries thereon at least a roller 28 around which is passed a web of adhesive tape 30 and in the disclosed embodiment carries three rollers 28 and tape 30.

Adhesive tape 30 is provided from supply spool 32 and accumulated after use on takeup spool 34. Takeup spool 34 is powered by drive 36 to wind the consumed ribbon onto the takeup spool 34 as carrier 26 translates from left to right across the path of ribbon 10. The translation of carrier 26 will place roller 28 in a position as indicated by the phantom lines with tape span 30 passing around roller 28. During such passage from left to right, platen 18 is lowered by platen lift control 22 to provide a solid backing for ribbon 10. Thus, substrate 12 and ink layer 14 are trapped between adhesive tape 30 and platen 18 with platen 18 providing a resistive backing force against ribbon 10. Carrier 26 is caused to translate from right to left by carrier drive 38 which drives the carrier in any conventional manner. This drive may be a chain drive, rack and pinion drive, leadscrew drive or any other suitable approach and is not a significant basis for this invention and, therefore, need not be described in detail.

As carrier 26 is moved to its leftmost limit of drive by carrier drive 38, the gripper 40 carried by carrier 26 is placed into engaging relationship with a foil composite 42. As carrier 26 is moved to the right by drive 38, gripper 40 under the influence of gripper control 44 will grasp foil composite 42 and pull foil composite to extend across the complete width of the path occupied by ribbon 10. Foil composite 42 is formed by unreeling foil 46 and at the same time pulling therewith a tape 48 which has adhesive on both sides. Foil 46 is provided with an adhesive material on one side which forms the inner surface of the wrap on its supply spool 50.

After carrier 26 has been withdrawn from between ribbon 10 and platen 20, platen lift control 24 may be energized to raise platen 20 to trap foil composite 42 and ribbon 10 between platen 20 and platen 18 and forcibly engage the adhesive side of foil composite 42 with the ink side 14 of ribbon 10.

Foil composite 42 may then be severed by any conventional technique such as hot wire, sheer or other severing device. The structure of the leader trailer has at this point been fabricated together with the ribbon 10 to form a composite laminate. This laminate may then be passed onto subsequent processing stations such as the slitter and winder of the type manufactured by The John Dusenbery Corporation of Randolph, N.J., Model No. 635TT.

Referring to FIG. 2, the ribbon stock 10 is adhesively engaged by the adhesive tape 30 as the tape 30 passes about roller 28. Rollers 28 are conveniently commonly mounted upon shaft 52 for ease in movement and control. As the tape passes about the periphery of roller 28 and is pulled downward from the ribbon 10, ink layer 14 is adhesively removed from substrate 12 and carried on the adhesive face of tape 30. After roller 28 has completed its passage, the ribbon stock 10 is as it appears in FIG. 3, greatly enlarged. The channels formed into ink layer 14 are those regions of the ink material which were removed by adhesive engagement with tape 30 as described with reference to FIG. 2. As the carrier 26 in FIG. 1 moves toward the right to pull the tape from engagement with ink layer 14 and remove the ink layer 14 from substrate 12, it also pulls foil composite 42 transverse to the length of ribbon stock 10.

Foil composite 42 is illustrated in FIG. 3. There may be separate foil composites for the leader and trailer. Face 54 of foil 56 is adhesive and is positioned to engage the ink side 14 of ribbon stock 10. Where foil 56 overlies a region where the ink layer 14 has been disrupted and removed, the adhesive surface 54 of foil 56 will then engage the substrate 12 for a firm adhesive attachment. Carried on the non-adhesive face 58 of foil 56 is a double-faced adhesive tape 60. Double-faced adhesive tape 60 will adhere on one side to the non-adhesive face 58 of foil 56 and will expose the second adhesive face of 62 of tape 60.

Referring again to FIG. 1, after foil composite 42 has been positioned transverse to the path of ribbon stock 10, platens 18 and 20 are actuated to squeeze the entire overlaid material into a laminated structure which is illustrated in FIG. 4. The squeezing of the adhesive faced foil 56 causes adherence to the substrate 12 where the ink layer 14 has been removed and further adheres to the ink layer 14 where the ink remains on the ribbon structure 10. The adhesive strips 60 with the adhesive face 62 exposed will then provide attachment point for the ribbon spools.

As the ribbon is slit, the transverse foil composites 42 will then become trailer and leader, the leader portion 64 being primarily for purposes of attaching the end of the ribbon to the takeup spool during final assembly of the ribbon assembly and the trailer 66 being primarily adapted for attachment to the supply spool with tape 60 and the extending out away from the supply spool for a finite distance of a non-inked surface on foil 56 to provide an encapsulated ink length of trailer from which printing cannot be accomplished through ink transfer. The portion 64 can be lengthened to form an encapsulated ink length of ribbon for clean handling, if required.

The substrate 12 is transparent to translucent and with the removal of the ink layer 14 in finite bands transverse to the bulk ribbon stock 10, a window 68 of some transmissability to light is created and overlaid subsequently with foil 56. This gap in the ink layer and thus the transmissability of light therethrough provides a visual warning to the operator that the end of the ink layer is imminent.

The length 70 of ribbon stock 10 is waste and results from characteristics of the techniques employed to slit the ribbon stock 10 and may vary from slitting machine type to slitting machine type.

Referring to FIG. 5, the ribbon 10 has been wound upon the spool and the leader severed from the bulk supply of the ribbon stock. The advantage of extending the foil 56 to either side of the region from which the ink layer 14 had been removed is that upon the complete sandwiching of the foil composite with the ribbon stock 10, a laminated structure results which has substantially enhanced rigidity and handling characteristics than that of the exceedingly thin film ribbon 10 by itself.

Figure 6:
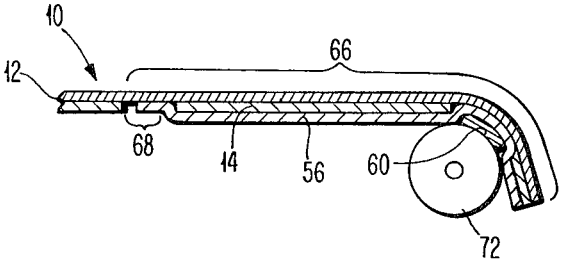
FIG. 6 illustrates the supply spool with the trailer attached thereto and not having been wound onto the supply spool.

FIG. 6 illustrates the trailer portion 66 of the ribbon 10 adhesively attached by tape 60 to the supply stool 72, with the foil 56 extending leftward from the point of attachment and overlying the ink layer 14 to provide a non-printing surface in conjunction with the end of ribbon warning window 68. The length of trailer portion 66 may be varied according to the desires of the person implementing the ribbon spool assembly and the needs of the ribbon feed mechanism upon which the ribbon assembly will be utilized.

Figure 7:
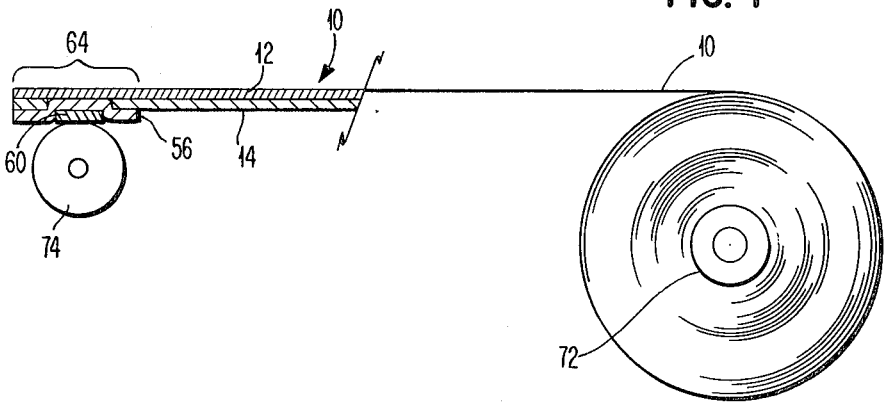
FIG. 7 illustrates a complete ribbon assembly with the leader attached to a takeup spool and the ribbon wound on the supply spool.

Referring to FIG. 7, takeup spool 74 is illustrated in bonding contact with the adhesive strip 60 on leader structure 64. The extension of foil 56 to one or both sides of the zone from which the ink layer 14 had been removed from substrate 12 adds rigidity through the laminating characteristics to the ribbon 10. In the event that a clean handling surface is desired over an extended length of the end of the ribbon, the foil 56 may be enlarged to provide any desired extended length toward the supply spool. It is also possible that an additional zone of ink removal may be desirable proximate to the edge of foil 56 if the length of the leader portion 64 is extended.

Alternative embodiments referred to in the Summary of the Invention as the simplest form, are illustrated in FIGS. 8, 9, 10 and 11.

Figure 8:
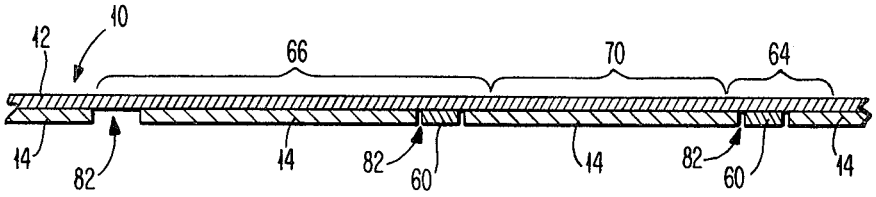
FIG. 8 illustrates the positions of the zones of the ink layer having been removed and the adhesive attaching foils positioned for subsequent attachment to the ribbon spools.

Referring to FIGS. 8, 9, 10 and 11, the alternative embodiments are illustrated. FIG. 8 illustrates the ribbon stock 10 with the ink layer 14 removed in three separate bands 82 as shown in FIG. 3 but with double-side adhesive tapes 60 applied only in two of the three bands 82 to provide attaching means and points for the ribbon spools.

Figure 9:
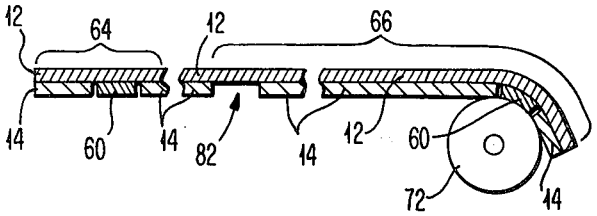
FIG. 9 illustrates the structure of FIG. 8 when assembled onto the ribbon spool.

The stock 10 in FIG. 8 comprised of the substrate 12, the ink layer 14 and the attaching adhesive tapes 60, is illustrated attached to the takeup spool 72 in FIG. 9. The stock 10 in FIG. 8 is cut such that segment 70 is removed and segment 66 forms the trailer of one ribbon and the ribbon structure in FIG. 9 will also have a segment 64 formed as the leader.

Figure 10:
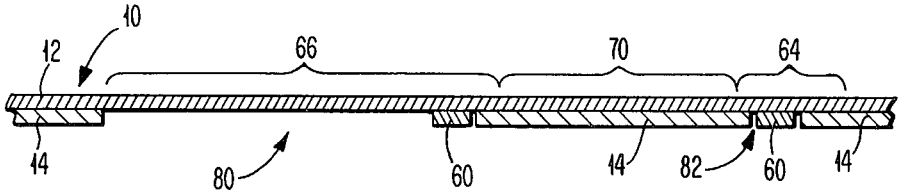
FIG. 10 illustrates a structure similar to FIG. 8 but having an enlarged portion of ink layer which has been removed to provide a trailer with no-print capability.

If desired, the ink layer 14 remaining in trailer segment 66 of FIG. 8 may also be removed merely by using one wide adhesive tape in lieu of two narrow adhesive tapes as shown in FIG. 2. If a wide adhesive tape is utilized, then the zone of ink removal will extend substantially throughout the trailer segment 66 and the adhesive attaching tape 60 may be positioned adjacent one end of the gap to provide for attachment to spool 72. When the entire zone of ink is removed such as illustrated in FIG. 10 at 80, the substrate 12 of the ribbon structure then becomes the uninked trailer portion of the spliceless ribbon providing not only end of ribbon warning but also a no-print capability equivalent to that provided by foil 56.

Figure 12:
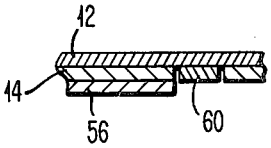
FIG. 12 illustrates an alternative arrangement of the adhesive attaching tapes and the foil being adjacent.
Figure 11:
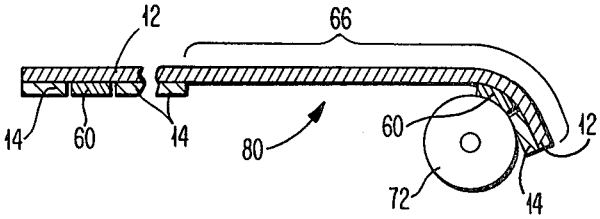
FIG. 11 illustrates the structure of FIG. 10 adhesively attached to the supply spool.

Referring to FIG. 12, the adhesive attaching tape 60 may be positioned side by side with the foil 56 as an alternative to juxtaposed positioning as in FIG. 4.

Figure 13:
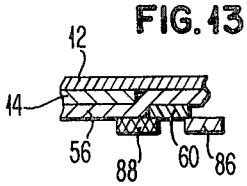
FIG. 13 illustrates a lead tape arrangement to aid in manufacture of the ribbons.

A further enhancement, illustrated in FIG. 13, is the application of a lead tape 86 on the leading edge of the adhesive attaching tapes 60 to prevent inadvertent adhesion of tape 60 to machine surfaces during slitting and spooling.

In order to assure that the leader 10 of the ribbon releases from the outer convolution of the ribbon disc and adhesive tape 60 remains with the leader when the leader is loosened to attach it to the takeup spool 74, lead tape 88 may be adhesively attached to adhesive tape 60 as shown in FIG. 13. The use of lead tape 86 on the trailer or lead tapes 86 and/or 88 on the leader will be dictated by manufacturing conditions and equipment and may or may not be required.

The enlarged views of the ribbon where attached to a spool such as in FIGS. 6, 7, 9 and 11 bear no dimensional relationship to the illustrated spools but are only illustrative of the method of engaging the spools with the adhesive tape 60.

In addition to simplifying the assembly of the ribbon structure with trailers and leaders, the leader and trailer structure also permit substantially enhanced possibilities for full and complete automation of the assembly of the leader/trailer composite to the bulk ribbon web 10. The control of gripper control 44 drives 36 and 38 and platen lift controls 22 and 24 are all conventional automated controls and may be implemented in any one of a number of possible ways according to the desires of the implementer.

It should be borne in mind that all of these controls could be implemented in such a way as to be manually operated and would still provide an enhanced ribbon structure inasmuch as the ribbon 10 would remain in a continuous web to insure integrity and proper alignment and feeding during the slitting and spooling operation and, as such, would still provide a finished ribbon spool of enhanced quality.

One additional advantage to the positioning of tape 60 on the leader portion 64 is that when the ribbon is slit and fully wound, the spool does not at that point of the manufacturing process have attached thereto the takeup spool 74. The adhesive strip 60 may be engaged with the outer wrap of ribbon 10 on the spool as illustrated in FIG. 5 thereby retaining the end of the ribbon 10 in a fixed location for handling and transporting of the ribbon disc 76 to subsequent assembly operations as needed. A further advantage to the leader laminate section 64 is that it will display sufficient rigidity for automated handling and assembly should that function be desirable from the producer's standpoint inasmuch as substantially better handling characteristics are provided by the laminate than would be a segment of the exceedingly thin film ribbon 10 without any supporting laminate structure. Characteristically, the laminate forms a type of bi-metallic action where the end will project from the ribbon circumference in a semi-rigid fashion.

I claim:

1. A spliceless single use bulk transfer type printing ribbon assembly comprising a pair of spools, a length of spliceless ribbon extending between said spools, said ribbon comprising an ink impermiable substrate and an ink layer thereon, a length of ink masking means adhesively attached to said ink and having an end proximate at least one end of said ribbon, and a zone of adhesive proximate each of said ends of said ribbon, and juxtaposed with said ink masking means and engaged with said spools.

2. The ribbon assembly of claim 1 wherein said ink layer has been selectively removed in an area proximate said ends of said ink masking means and said ink masking means is adhesively engaged in said area with said substrate to enhance adhesion.

3. A bulk transfer type printer ribbon having an ink impermeable substrate having a first side and a second side and a marking ink on said second side forming a composite, said composite having an inner end and an outer end and wound on a hub to form a ribbon disc with an uninked leader on the outer end of said wound composite and an uninked trailer on said inner end, the improvement comprising said leader and trailer comprising a foil of an uninked material adhesively attached on said second side only, said uninked material adhesively attached to said second side of said substrate, said substrate having said marking ink locally adhesively removed therefrom prior to said adhesive attachment.

4. The printer ribbon of claim 3 wherein said local removal of said marking ink extends entirely transverse to said ribbon and coincides with the ends of said trailer material.

5. The printer ribbon of claim 3 wherein said leader and trailer further comprise a region of adhesive material adhered to said leader and trailer on a side opposite said first side of said substrate.

6. The method of making and winding small printer useable rolls of bulk transfer type ribbon having an ink impermeable substrate and a layer of bulk transfer marking material on one surface of said substrate from bulk rolls of said ribbon wherein the improvement comprises providing an uninked foil selectively adhesively removing said marking material in a region adhesively engageable by said uninked foil to provide adhesive engagement between the end of said foil and said substrate, adhesively applying to said ribbon over said marking material and said region an uninked foil to form a laminate of a substrate, a marking material on said substrate and said uninked foil, subsequently slitting said ribbon and said laminate, winding said slit ribbon and laminate on plurality of spools to form printer useable rolls of ribbon with a leader and trailer and severing said roll at said laminate.

7. The method of claim 6 wherein said marking material is selectively removed from said substrate by engaging said marking material of said ribbon in the region of desired removal with an adhesive member, forcibly removing said adhesive member from engagement with said ribbon and pulling said marking material from said substrate.

8. A spliceless single use bulk transfer type printing ribbon comprising:

a length of spliceless ribbon substrate having two ends;

a layer of transferrable ink;

a deinked region proximate each of said ends having said layer of ink removed from said ribbon substrate, adhesive attaching means adhesively engaged with said deinked regions and having adhesive surfaces exposed for attachment to spools.

9. The printing ribbon of claim 8 further comprising a zone of ribbon proximate one end of said ribbon having said ink layer removed therefrom whereby an end of ribbon warning zone is created.

10. The printing ribbon of claim 9 wherein said zone is sufficiently wide to be adjacent one of said regions whereby a non-printing trailer is formed.

11. The method of making a spliceless bulk transfer type printer ribbon comprising the steps of providing a ribbon composite comprising an ink impermiable substrate and a layer of bulk transfer type ink marking material thereon, selectively removing at least a zone of said ink marking material from said substrate and adhesively applying an adhesive attaching means to said substrate in said region where said ink marking material has been removed.

12. The method of claim 11 wherein said ribbon composite is slit to provide a plurality ribbons of machine useable width.

13. The method of claim 11 or 12 further comprising the steps of adhesively attaching said adhesive attaching means to at least a spool and spooling said composite onto said spool.

14. The method of claim 11 further comprising a step of selectively removing a further zone of said ink marking material from said substrate, thereby forming an end of ribbon warning.

15. The method of claim 11 wherein said ink marking material is removed from a zone proximate each end of said composite and said adhesive attaching means is applied to each of said zones.

* * * * *